US005301419A

United States Patent [19]

Mitani et al.

[11] Patent Number: 5,301,419

[45] Date of Patent: Apr. 12, 1994

[54] CABLE GUIDE BACK FOR USE IN A CABLE CONNECTION PROCESSING APPARATUS

[75] Inventors: Goichi Mitani; Masaoki Yasumi; Akihiro Muraoka, all of Tokyo, Japan

[73] Assignee: Japan Aviation Electronics Industry, Limited, Japan

[21] Appl. No.: 821,382

[22] Filed: Jan. 14, 1992

[30] Foreign Application Priority Data

Jan. 17, 1991 [JP] Japan ..... 3-15671

[51] Int. Cl.[5] ..... H01R 43/04

[52] U.S. Cl. ..... 29/753; 29/759

[58] Field of Search ..... 29/751, 753, 759, 760, 29/761

[56] References Cited

U.S. PATENT DOCUMENTS 4,649,636 3/1987 Arbogast, Jr. et al. ..... 29/753 X

*Primary Examiner*—Carl E. Hall

*Attorney, Agent, or Firm*—Laff, Whitesel, Conte & Saret

[57] ABSTRACT

A cable guide block has a guide groove for receiving and guiding an end portion of a cable having an elastically deformable sheath. The guide block is for use in a cable connection processing apparatus for making a cable connection by moving a cable pusher in a direction perpendicular to the guide groove and in a cable receiving direction in order to press the end portion of the cable onto a cable connection portion of a contact disposed below the guide groove. The guide groove has a pair of wall surfaces which are spaced apart by a distance which is greater than a diameter of the cable. At least one projection is formed on at least one of the wall surfaces so that the distance between the wall surfaces is less than the diameter of the cable. By the use of the cable guide block, the end portion of the cable is reliably sent along the cable receiving direction and inserted into the guide groove. The end portion of the cable is forced against the positioning projection in an elastically deformed condition. At that time, the end portion of the cable is connected to the cable connection portion of the contact.

13 Claims, 9 Drawing Sheets

CABLE GUIDE BACK FOR USE IN A CABLE CONNECTION PROCESSING APPARATUS

BACKGROUND OF THE INVENTION

This invention relates to a cable guide block for use in a cable connection processing apparatus and, in particular, to a cable guide block for use in a cable connection processing apparatus to connect an end portion of a cable terminated by a cut end to a cable connection portion of an electroconductive contact.

A conventional cable connection processing apparatus comprises a cable guide block provided with a guide groove for receiving an end portion of a cable, and a cable pusher movable with respect to the guide groove in a direction perpendicular to a cable receiving direction along which the cable is introduced into the guide groove. The cable pusher is for pushing the end portion of the cable onto a cable connection portion of a contact mounted in an electric connector disposed below the guide groove so as to carry out connection operation. The cable is covered by a sheath made of an elastically deformable material such as polyvinyl chloride resin.

The cable guide block comprises a first surface facing the cable pusher for pushing the end portion of the cable onto the cable connection portion, a second surface opposite to the first surface, and a third surface confronting an end face of the cable being inserted. The guide groove is formed in the third surface and extends from the first surface to the second surface. The guide groove comprises a pair of wall surfaces for guiding the end portion of the cable, and a bottom surface for receiving the end face of the cable. A distance between the wall surfaces is greater than a diameter of the cable.

The end portion of the cable is guided into the guide groove above the cable connection portion and moved in the cable receiving direction until the end face of the cable is received by the bottom surface of the guide groove. Thus, the end portion of the cable is placed in a proper position for connection. Then, the cable pusher is downwardly moved from a standby location above the guide groove in a direction perpendicular to the cable receiving direction to thereby push the end portion of the cable downwards. Consequently, the end portion of the cable is pressed onto the cable connection portion of the contact disposed below the guide groove to thereby carry out connection operation.

In the above-described cable guide block, the pair of the wall surfaces of the guide groove are planar and parallel to each other and are spaced with a distance greater than the diameter of the cable. Therefore, when the cable is moved along the cable receiving direction, the end portion of the cable is allowed to be bent aside. In this connection, the end face of the cable may reach a wrong position deviated from the bottom surface of the guide groove. More specifically, the end face of the cable may be received by the cable connection portion of the contact disposed below the cable guide block or by the cable pusher located above the cable guide block. Thus, the cable is possibly be placed in a wrong position.

In another conventional cable connection processing apparatus, a moving mechanism for moving a cable in a cable receiving direction per se comprises a positioning mechanism. Such apparatus is also disadvantageous in that the cable may be placed in a wrong position when the end face of the cable does not reach a predetermined position of the guide groove due to presence of a twist in the cable which has been wound around a reel.

As described above, it is impossible to reliably connect the end portion of the cable to the cable connection portion of the contact unless the end portion of the cable is placed at a predetermined position of the guide groove.

SUMMARY OF THE INVENTION

It is therefore an object of this invention to provide a cable guide block which is for use in a cable connection processing apparatus for carrying out connection processing such as press contact and press bonding between a cable and a cable connection portion of a contact and which can improve efficiency and reliability in cable connection operation.

A cable guide block to which this invention is applicable is provided with a guide groove for receiving an end portion of a cable and is for use in a cable connection processing apparatus for carrying out cable connection operation by moving a cable pusher with respect to the guide groove in a direction perpendicular to a cable receiving direction to press the end portion of the cable onto a cable connection portion of a contact disposed below the guide groove. The cable guide block according to this invention comprises a first surface facing the cable pusher for pushing the end portion of the cable onto the cable connection portion, a second surface opposite to the first surface, a third surface confronting an end face of the cable being inserted, and the guide groove formed in the third surface and extending from the first surface to the second surface. The guide groove comprises a cable inserting opening formed in the third surface for receiving the end portion of the cable, a pair of wall surfaces for guiding the end portion of the cable, a bottom surface for receiving the end face of the cable, a first opening formed in the first surface for receiving the cable pusher, and a second opening formed in the second surface for permitting the end portion of the cable to be pushed out therethrough. A distance between the wall surfaces is generally greater than a diameter of the cable. At least one projection is formed on at least one of the wall surfaces so that the distance between the wall surfaces is partially made smaller than the diameter of the cable.

According to an aspect of this invention, the above-described cable guide block for use in a cable connection processing apparatus is characterized in that the projection is formed in the vicinity of an edge portion of the first opening.

According to a second aspect of this invention, the above-described cable guide block for use in a cable connection processing apparatus is characterized in that the projection is formed in the vicinity of an edge portion of the second opening.

According to a third aspect of this invention, the above-described cable guide block for use in a cable connection processing apparatus is characterized in that the projection is formed on each of the wall surfaces in the vicinity of an edge portion of the first opening.

According to a fourth aspect of this invention, the above-described cable guide block for use in a cable connection processing apparatus is characterized in that the projection is formed on each of the wall surfaces in the vicinity of an edge portion of the second opening.

According to a fifth aspect of this invention, the above-described cable guide block for use in a cable connection processing apparatus is characterized in that the projections are formed on each of the wall surfaces in the vicinity of edge portions of the first and the second openings.

According to a sixth aspect of this invention, the above-described cable guide block for use in a cable connection processing apparatus is characterized in that the projection is formed into a rib shape.

According to a seventh aspect of this invention, the above-described cable guide block for use in a cable connection processing apparatus is characterized in that the projection has a side surface perpendicular to the wall surface.

According to an eighth aspect of this invention, the above-described cable guide block for use in a cable connection processing apparatus is characterized in that the projection has a side surface slanted against the wall surface.

According to a ninth aspect of this invention, the above-described cable guide block for use in a cable connection processing apparatus is characterized in that the projection has a side surface curved into a concave shape.

According to a tenth aspect of this invention, the above-described cable guide block for use in a cable connection processing apparatus is characterized in that the projection has a side surface curved into a convex shape.

According to an eleventh aspect of this invention, the above-described cable guide block for use in a cable connection processing apparatus is characterized in that the projection has a side surface provided with at least one step portion.

According to a twelfth aspect of this invention, the last-mentioned cable guide block for use in a cable connection processing apparatus is characterized in that a distance between the wall surfaces is partially made smaller than a diameter of the cable by presence of the step portion and is further made smaller by presence of the projection.

DESCRIPTION OF THE PREFERRED EMBODIMENT

Figure 1:
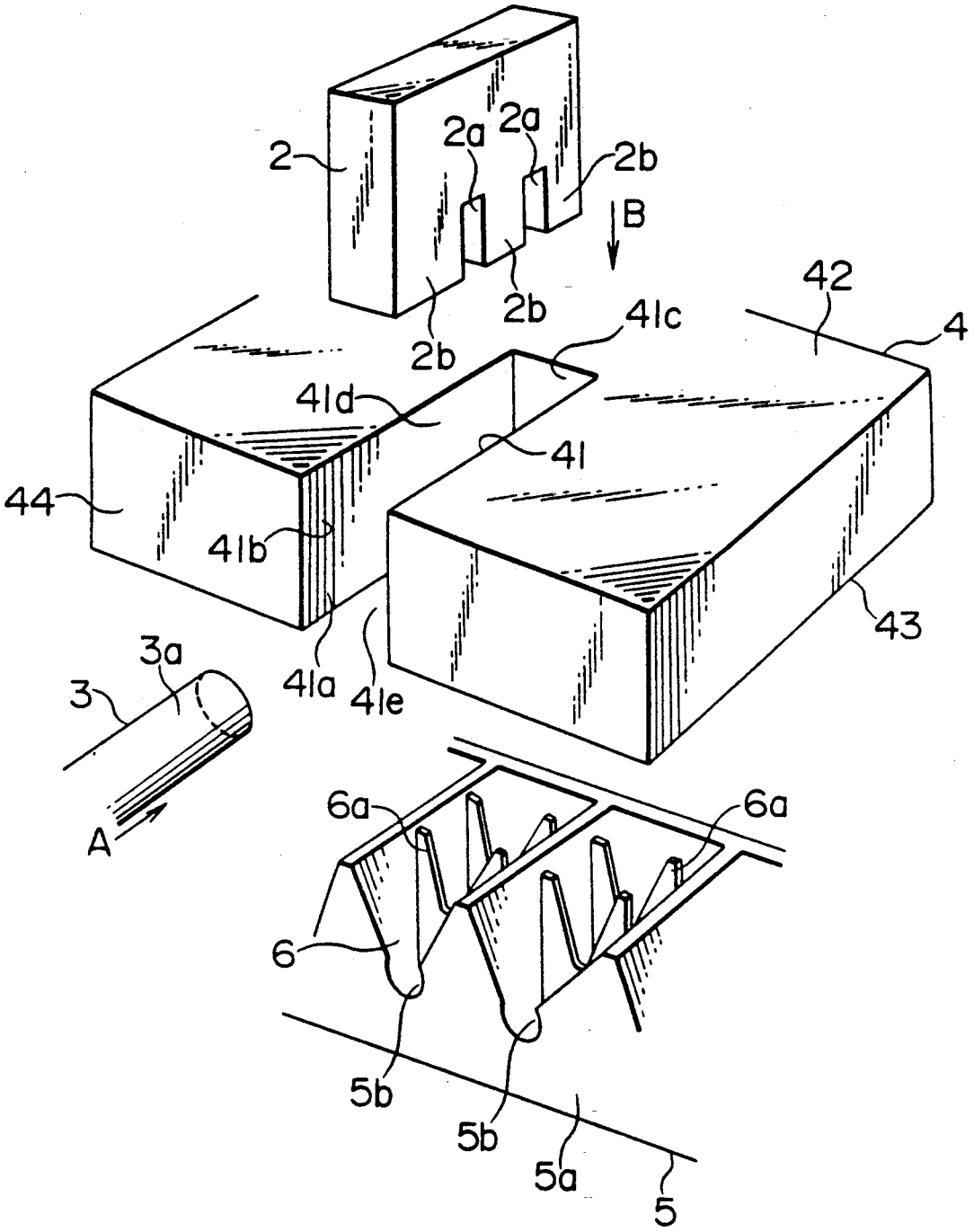
FIG. 1 PRIOR ART
FIG. 1 is a perspective view for describing press contact operation between a cable and a cable connection portion of a contact by the use of a conventional cable guide block for use in a cable connection processing apparatus.
Figure 2:
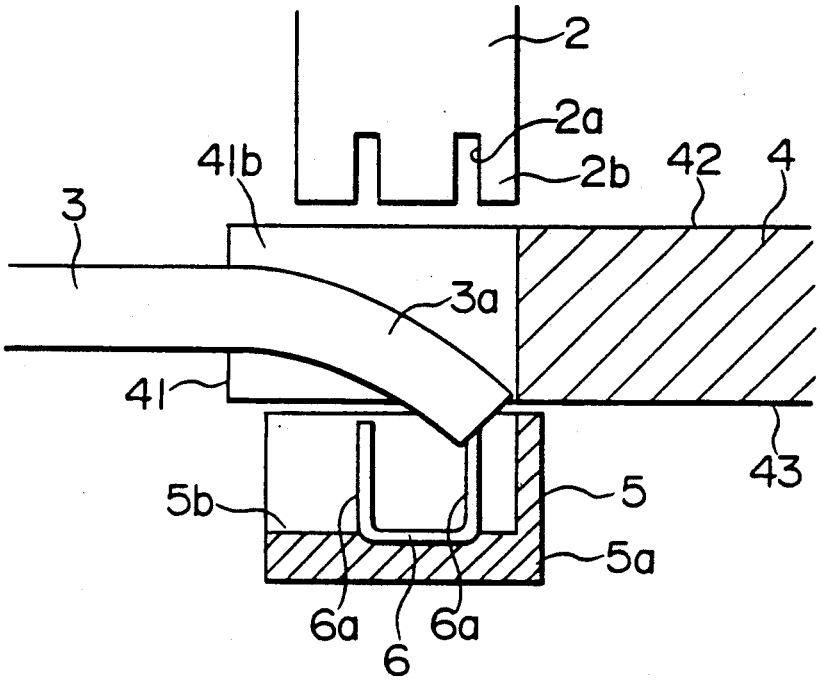
FIG. 2 PRIOR ART
FIG. 2 is a sectional view for further describing the press contact operation between the cable and the cable connection portion of the contact by the use of the conventional cable guide block shown in FIG. 1.
Figure 3:
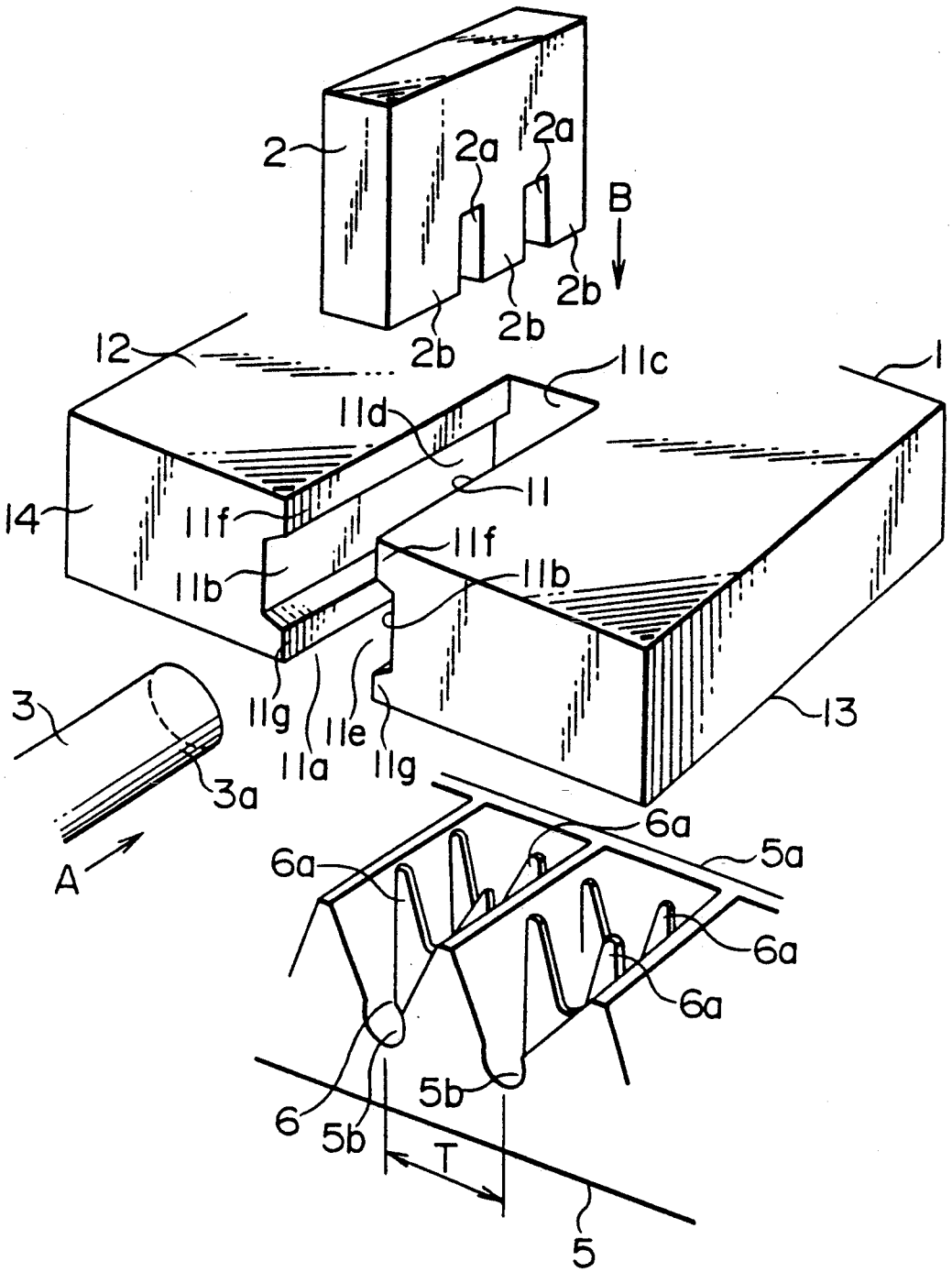
FIG. 3 is a perspective view for describing press contact operation between a cable and a cable connection portion of a contact by the use of a cable guide block for use in a cable connection processing apparatus according to a first embodiment of this invention.

For a better understanding of this invention, description will at first be made as regards a conventional cable guide block for use in a cable connection processing apparatus with reference to FIGS. 1 and 2.

Referring to FIG. 1, a conventional cable connection processing apparatus comprises a cable guide block 4 provided with a guide groove 41 for receiving an end portion 3*a* of a cable 3, and a cable pusher 2 movable with respect to the guide groove 41 in a direction (depicted at B in the figure) perpendicular to a cable receiving direction (depicted at A in the figure). The cable pusher 2 is for pushing the end portion 3*a* of the cable 3 onto a cable connection portion 6*a* of a contact 6 mounted in an electric connector 5 so as to carry out connection operation. The connector 5 is located below the guide groove 41. The contact 6 is enclosed in an insulator 5*a* of the connector 5. The insulator 5*a* is provided with a plurality of contact receptacle grooves 5*b*.

It is noted here that a plurality of contacts 6 are mounted in the plurality of contact receptacle grooves 5*b* in one-to-one correspondence. As is also shown in FIG. 2, the contact 6 in each contact receptacle groove 5*b* is provided with the cable connection portion 6*a* having a U-shaped recess. The cable 3 comprises a core wire covered by a sheath made of an elastically deformable material such as polyvinyl chloride resin.

The cable pusher 2 comprises a plurality of grooves 2*a* spaced at a distance equal to a distance between a pair of upright plates of the cable connection portion 6*a* and having a width slightly larger than that of the upright plates of the cable connection portion 6*a*, and a plurality of protrusions 2*b* having a width substantially equal to the distance between the upright plates of the cable connection portion 6*a*.

The cable guide block 4 comprises a first surface 42 facing the cable pusher 2 for pushing the end portion 3*a* of the cable 3 from a position inside the guide groove 41 onto the cable connection portion 6*a*, a second surface 43 opposite to the first surface 42, and a third surface 44 confronting an end face of the cable 3 being inserted. The guide groove 41 is formed in the third surface 44 and extends from the first surface 42 to the second surface 43. The guide groove 41 comprises a cable inserting opening 41*a* formed in the third surface 44 for inserting the end portion 3*a* of the cable 3, a pair of wall surfaces 41*b* for guiding the end portion 3*a* of the cable 3, a bottom surface 41*c* for receiving the end face of the cable 3, a first opening 41*d* formed in the first surface 42 for receiving the cable pusher 2, and a second opening 41*e* formed in the second surface 43 for permitting the end portion 3*a* of the cable 3 to be pushed out therethrough. A distance between the wall surfaces 41*b* is slightly larger than a diameter of the cable 3.

Connection operation between the end portion 3*a* of the cable 3 and the cable connection portion 6*a* is carried out in the manner which will now be described.

The cable 3 is terminated by a cut end forming the end face perpendicularly intersecting the cable receiving direction. The cable guide block 4 guides the end portion 3*a* of the cable 3 in the guide groove 41 above the cable connection portion 6*a* to send the end portion 3*a* of the cable 3 in the cable receiving direction A. Finally, the end face of the cable 3 is received by the bottom surface 41*c* of the guide groove 41 to place the end portion 3*a* of the cable 3 in a proper position for connection. Subsequently, the cable pusher 2 is moved down from a standby position above the guide groove 41 in the direction B perpendicular to the cable receiving direction A so that the end portion 3*a* of the cable 3 is pushed down by the protrusions 2*b*. Thus, the end portion 3*a* of the cable 3 is brought into press contact with the cable connection portion 6*a* of the contact 6.

However, in the above-described conventional cable guide block 4, the end portion 3*a* of the cable 3 may be placed in a wrong position when it is received by the cable connection portion 6*a* of the contact 6 located below the cable guide block 4 or by the cable pusher 2 located above the cable guide block 4. In other words, the end face of the cable 3 can not reach a predetermined position when the cable 3 is bent aside. Thus, it is difficult in the conventional cable guide block to place the end portion 3*a* of the cable 3 at a proper position for connection.

Description will now be made as regards a cable guide block for use in a cable connection processing apparatus according to an embodiment of this invention with reference to FIGS. 3 through 6.

Figure 4:
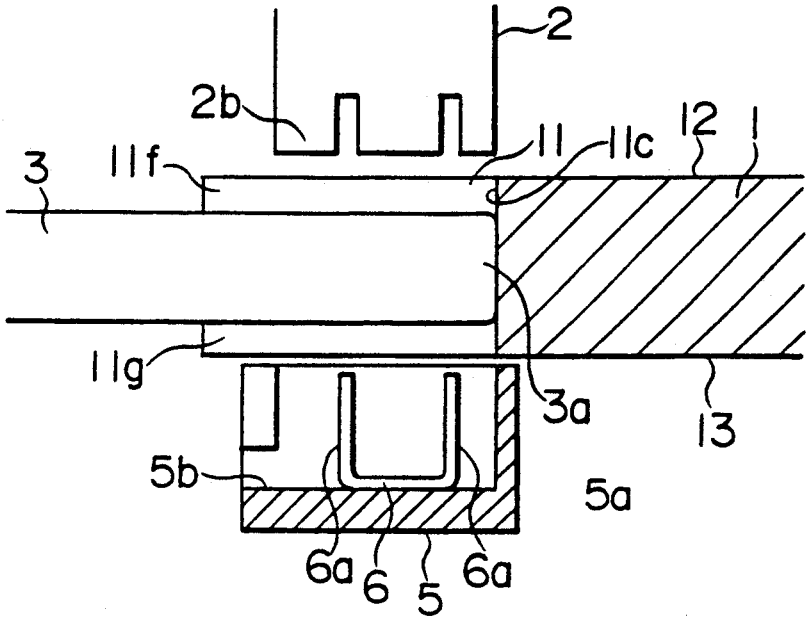
FIG. 4 is a sectional view for further describing the press contact operation between the cable and the cable connection portion of the contact by the use of the cable guide block shown in FIG. 3.

Referring to FIGS. 3 through 6, the cable connection processing apparatus comprises a cable guide block 1 provided with a guide groove 11 for receiving an end portion 3*a* of a cable 3, and a cable pusher 2 movable with respect to the guide groove 11 in a direction (depicted at B in the figure) perpendicular to a cable receiving direction (depicted at A in the figure) along which the cable 3 is introduced into the guide groove 11. The cable pusher 2 is for pressing the end portion 3*a* of the cable 3 onto a cable connection portion 6*a* of a contact 6 mounted in an electric connector 5 so as to carry out connection operation. The connector 5 is located below the guide groove 11. The connector 5 has an insulator 5*a*. The insulator 5*a* is provided with a plurality of contact receptacle grooves 5*b*. It is noted here that a plurality of contacts 6 are mounted in the plurality of contact receptacle grooves 5*b* in one-to-one correspondence. As is also shown in FIG. 4, the contact 6 in each contact receptacle groove 5*b* is provided with the cable connection portion 6*a* having a U-shaped recess and facing the guide groove 11. The cable 3 comprises a core wire covered by a sheath made of an elastically deformable material such as polyvinyl chloride resin.

The cable pusher 2 comprises a plurality of grooves 2*a* spaced at a distance equal to a distance between a pair of upright plates of the cable connection portion 6*a* and having a width slightly larger than that of the upright plates of the cable connection portion 6*a*, and a plurality of protrusions 2*b* having a width substantially equal to the distance between the upright plates of the cable connection portion 6*a*.

The cable guide block 1 comprises a first surface 12 facing the cable pusher 2 for pushing the end portion 3*a* of the cable 3 downwards onto the cable connection portion 6*a*, a second surface 13 opposite to the first surface 12, and a third surface 14 confronting an end face of the cable 3 being inserted. The guide groove 11 is formed in the third surface 14 and extends from the first surface 12 to the second surface 13. The guide groove 11 comprises a cable inserting opening 11*a* formed in the third surface 14 for inserting the end portion 3*a* of the cable 3, a pair of wall surfaces 11*b* for guiding the end portion 3*a* of the cable 3, a bottom surface 11*c* for receiving the end face of the cable 3, a first opening 11*d* formed in the first surface 12 for receiving the cable pusher 2, and a second opening 11*e* formed in the second surface 13 for permitting the end portion 3*a* of the cable 3 to be pushed out therethrough. The pair of the wall surfaces 11*b* are provided with four projections comprising a pair of projections 11*f* and another pair of projections 11*g* in the vicinity of edge portions of the first and the second openings 11*d* and 11*e*, respectively. Each of these projections 11*f* and 11*g* is formed into a rib shape and extends along the cable receiving direction A. It is noted here that each of the projections 11*f* and 11*g* may be formed by a plurality of small studs aligned along the cable receiving direction A. As explicitly shown in FIG. 5, a distance $(d+w)$ between the pair of the wall surfaces 11*b* is slightly larger than a diameter d of the cable 3, where w represents a height of the projection. A distance $(d-w)$ between the projections 11*f* is smaller than the diameter d of the cable 3.

Connection operation between the end portion 3*a* of the cable 3 and the cable connection portion 6*a* of the contact 6 is carried out in the manner which will now be described.

The end face of the cable 3 is inserted into the guide groove 11 through the cable inserting operating 11*a* in the cable receiving direction A. The end portion 3*a* of the cable 3 is guided in the guide groove 11 above the cable connection portion 6*a* of the contact 6 to be sent along the cable receiving direction A. In this event, the end portion 3*a* of the cable 3 is forced by the projections 11*f* and 11*g* of the guide groove 11 to be sent straightforward. The end portion 3*a* of the cable 3 is placed at a predetermined location when the end face of the cable 3 is received by the bottom surface 11*c* of the guide groove 11. Subsequently, the cable pusher 2 is moved down from a standby position above the guide groove 11 in the direction B perpendicular to the cable receiving direction A. More specifically, the protrusions 2*b* of the cable pusher 2 are inserted into the guide groove 11 through the first opening 11*d* to push the end portion 3*a* of the cable 3 in a downward direction. In this event, the sheath of the end portion 3*a* of the cable 3 is elastically deformed when the end portion 3*a* passes between the projections 11*g* formed in the vicinity of the edge portions of the second opening 11*e*. When the cable pusher 2 is further moved down, the end portion 3*a* of the cable 3 is pressed onto the cable connection portion 6*a* of the contact 6 to be brought into press contact. The sheath of the cable 3 is torn off by the cable connection portion 6*a* of the contact 6 so that the core wire of the cable 3 and the cable connection portion 6*b* are electrically connected.

Figure 6:
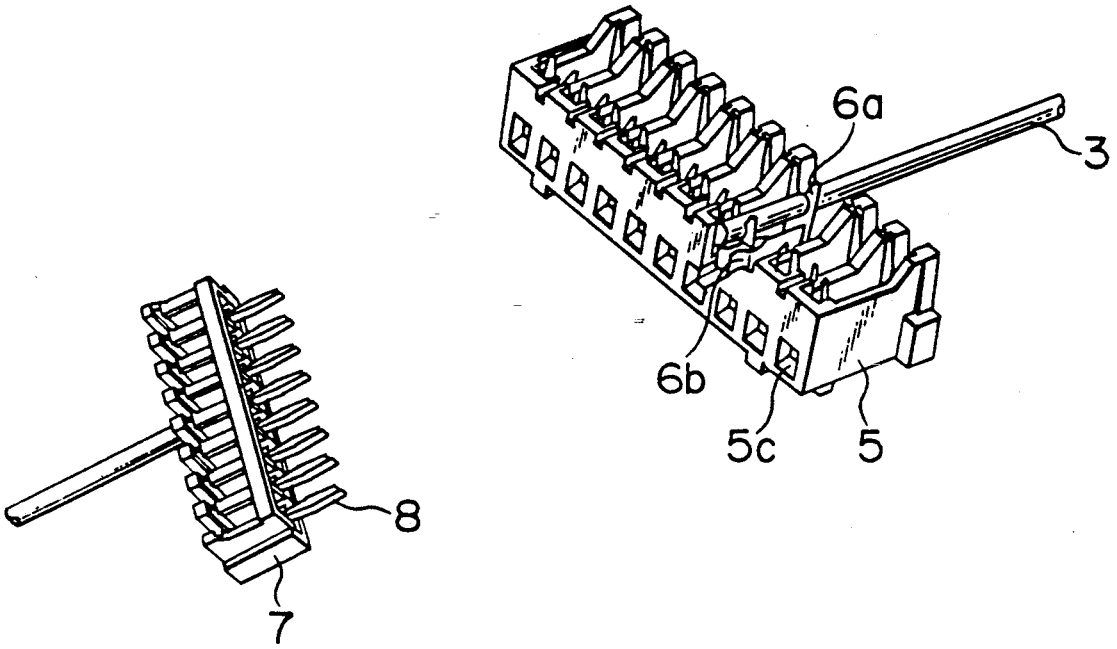
FIG. 6 is a perspective view illustrating an example of a connector after completion of cable connection operation and a mating connector to be coupled to the connector.

FIG. 6 shows the connector 5 after completion of connection operation and a mating connector 7 to be coupled to the connector 5. In this embodiment, mating contacts 8 of the mating connector 7 are inserted into insertion holes 5*c* of the connector 5 in one-to-one correspondence. Thus, the contact portion 6*a* of the contact 6 is connected to a corresponding one of the mating contacts 8.

Figure 7:
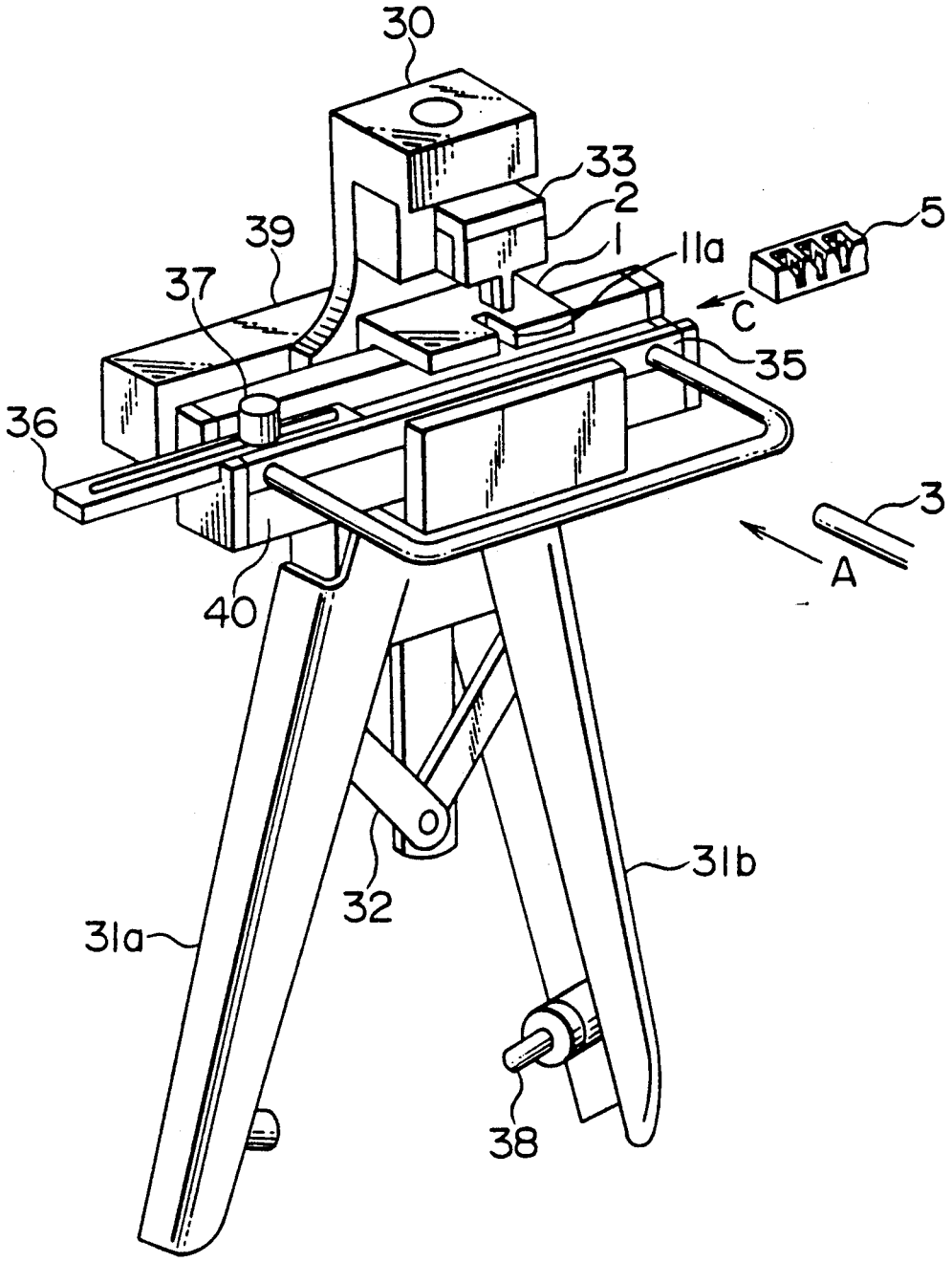
FIG. 7 a perspective view illustrating a cable connection processing apparatus for carrying out press contact operation between a cable and a cable connection portion by the use of the cable guide block according to the first embodiment of this invention.

FIG. 7 shows an embodiment of a hand tool for connection processing of a cable by press contact operation as described above. The hand tool has a body 30 provided with a left handle 31*a* and a right handle 31*b*. When the left and the right handles 31*a* and 31*b* are closed, a cable pusher holder 33 is downwardly moved through a link 32. At the same time, the cable pusher 2 attached to the cable pusher holder 33 is downwardly moved also. The connector 5 is preliminarily inserted in a connector holder 35 along a direction C and placed at a loading position at which the connector 5 is received by a connector stopper 36. The connector stopper 36 controllably varies a fastening location by a connector stopper fastening bolt 37 in accordance with a size of the connector 5. Thus, the connector 5 is secured to the connector holder 35.

After the connector 5 is secured as described above, the cable 3 is inserted into the guide groove 11 along the cable receiving direction A and placed at a proper position. Thereafter, the cable pusher 2 is moved down into the guide groove 11. Thus, the end portion 3*a* of the cable 3 is connected to the cable connection portion 6*a* by press contact. A lower dead point of the cable pusher 2 is adjusted by a stopper bolt 38 projecting in a direction along which the handles 31*a* and 31*b* are closed. When the handles 31*a* and 31*b* are opened after completion of connection operation, the movement is transmitted to a connector holder unit 40 through a pitch feed mechanism 39. The connector holder unit 40 is moved along the direction C by one pitch (the interval T between the adjacent contact receptacle grooves 5*b* in FIG. 3) to prepare for a next connection operation. Likewise, end portions of a plurality of cables are successively connected to the connector 5 one by one with the movement in a pitch feed direction.

In the foregoing embodiment, the wall surfaces 11*b* of the guide groove 11 are provided with four projections 11*f* and 11*g* in total. However, one through three projections 11*f* and/or 11*g* may be formed at an appropriate location or locations of the wall surfaces 11*b*. Various examples are shown in FIGS. 8 through 19.

Figure 8:
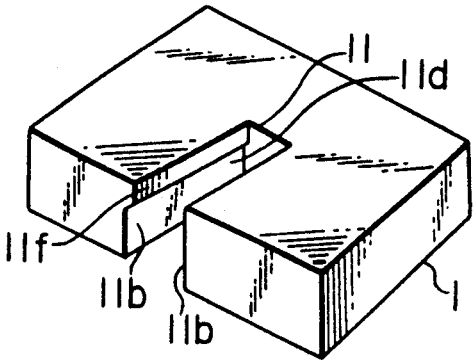
FIG. 8 is a perspective view illustrating a cable guide block according to a second embodiment of this invention.

In the cable guide block 1 illustrated in FIG. 8, one projection 11*f* is formed on one of the wall surfaces 11*b* of the guide groove 11 in the vicinity of the edge portion of the first opening 11*d*.

Figure 9:
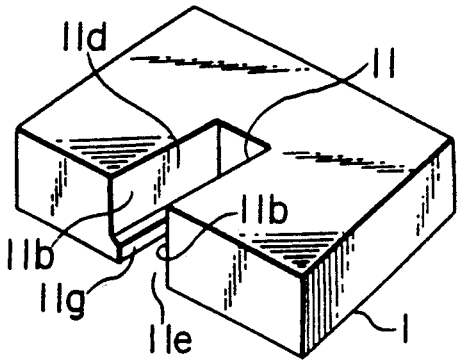
FIG. 9 is a perspective view illustrating a cable guide block according to a third embodiment of this invention.

In the cable guide block 1 illustrated in FIG. 9, one projection 11*g* is formed on one of the wall surfaces 11*b* of the guide groove 11 in the vicinity of the edge portion of the second opening 11*e*.

Figure 10:
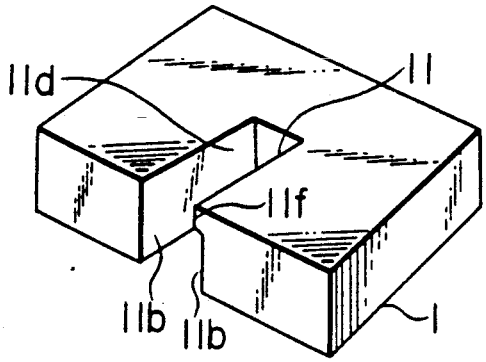
FIG. 10 is a perspective view illustrating a cable guide block according to a fourth embodiment of this invention.

In the cable guide block 1 illustrated in FIG. 10, one projection 11*f* is formed on other of the wall surfaces 11*b* opposite to one of the wall surfaces 11*b* of the guide groove 11 in the vicinity of the edge portion of the first opening 11*d*.

Figure 11:
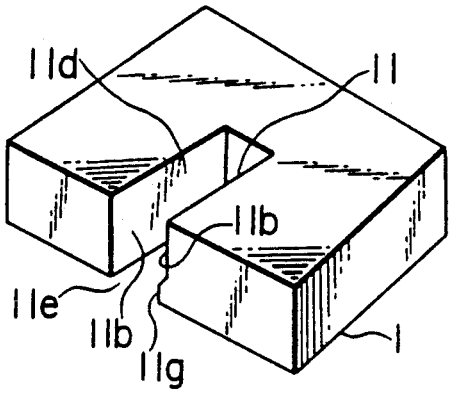
FIG. 11 is a perspective view illustrating a cable guide block according to a fifth embodiment of this invention.

In the cable guide block 1 illustrated in FIG. 11, one projection 11*g* is formed on other of the wall surfaces 11*b* opposite to one of the wall surfaces 11*b* of the guide groove 11 in the vicinity of the edge portion of the second opening 11*e*.

Figure 12:
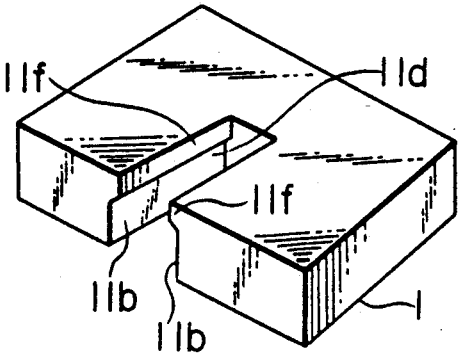
FIG. 12 is a perspective view illustrating a cable guide block according to a sixth embodiment of this invention.

In the cable guide block 1 illustrated in FIG. 12, two projections 11*f* are individually formed on the respective wall surfaces 11*b* in the vicinity of the edge portions of the first opening 11*d*.

Figure 13:
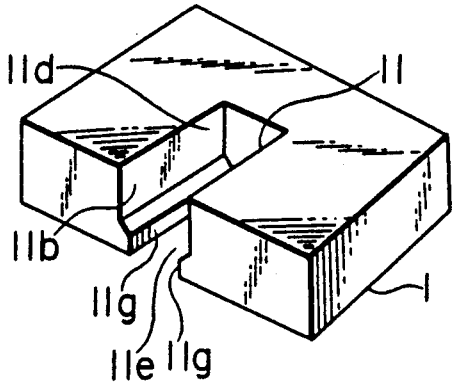
FIG. 13 is a perspective view illustrating a cable guide block according to a seventh embodiment of this invention.

In the cable guide block 1 illustrated in FIG. 13, two projections 11*g* are individually formed on the respective wall surfaces 11*b* in the vicinity of the edge portions of the second opening 11*e*.

Figure 14:
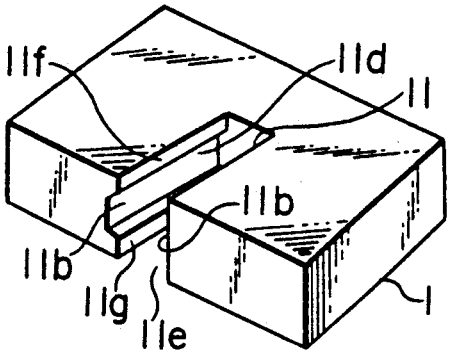
FIG. 14 is a perspective view illustrating a cable guide block according to an eighth embodiment of this invention.

In the cable guide block 1 illustrated in FIG. 14, two projections 11*f* and 11*g* are both formed on one of the wall surfaces 11*b* in the vicinity of the edge portions of the first and the second openings 11*d* and 11*e*, respectively.

Figure 15:
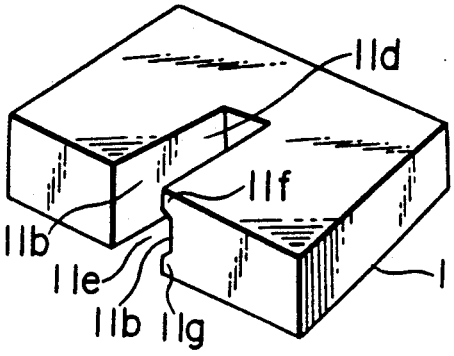
FIG. 15 is a perspective view illustrating a cable guide block according to a ninth embodiment of this invention.

In the cable guide block 1 illustrated in FIG. 15, two projections 11*f* and 11*g* are both formed on other of the wall surface 11*b* opposite to one of the wall surfaces 11*b* in the vicinity of the edge portions of the first and the second openings 11*d* and 11*e*, respectively.

Figure 16:
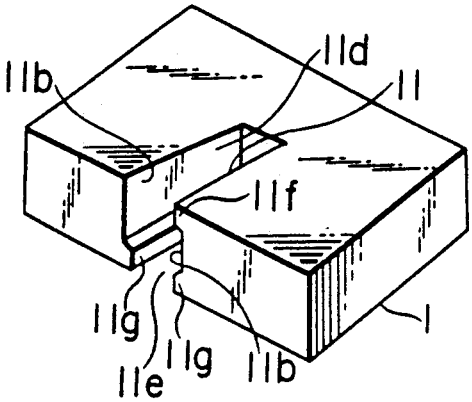
FIG. 16 is a perspective view illustrating a cable guide block according to a tenth embodiment of this invention.

In the cable guide block 1 illustrated in FIG. 16, one projection 11*g* is formed on one of the wall surfaces 11*b* in the vicinity of the edge portion of the second opening 11*e*. In addition, two projections 11*f* and 11*g* are both formed on the other of the wall surfaces 11*b* in the vicinity of the edge portions of the first and the second openings 11*d* and 11*e*, respectively.

Figure 17:
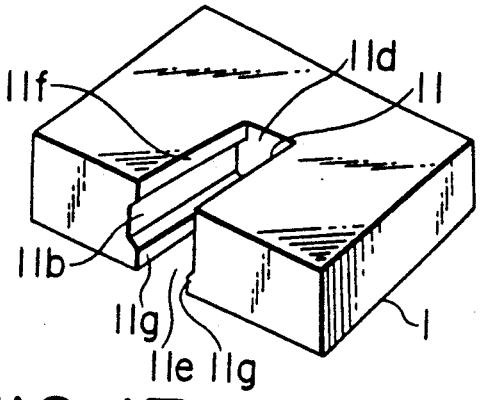
FIG. 17 is a perspective view illustrating a cable guide block according to an eleventh embodiment of this invention.

In the cable guide block 1 illustrated in FIG. 17, one projection 11*g* is formed on other of the wall surfaces 11*b* in the vicinity of the edge portion of the second opening 11*e*. In addition, two projections 11*f* and 11*g* are both formed on one of the wall surfaces 11*b* in the vicinity of the edge portions of the first and the second openings 11*d* and 11*e*, respectively.

Figure 18:
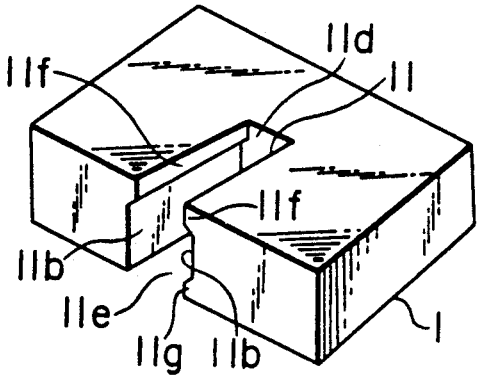
FIG. 18 is a perspective view illustrating a cable guide block according to a twelfth embodiment this invention.

In the cable guide block 1 illustrated in FIG. 18, one projection 11*f* is formed on one of the wall surfaces 11*b* in the vicinity of the edge portion of the first opening 11*d*. In addition, two projections 11*f* and 11*g* are both formed on other of the wall surfaces 11*b* in the vicinity of the edge portions of the first and the second openings 11*d* and 11*e*, respectively.

Figure 19:
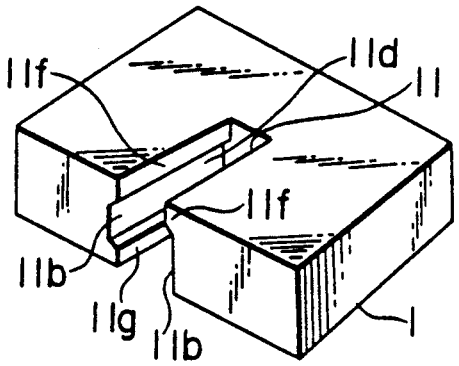
FIG. 19 is a perspective view illustrating a cable guide block according to a thirteenth embodiment of this invention.

In the cable guide block 1 illustrated in FIG. 19, one projection 11*f* is formed on other of the wall surfaces 11*b* in the vicinity of the edge portion of the first opening 11*d*. In addition, two projections 11*f* and 11*g* are both formed on one of the wall surfaces 11*b* in the vicinity of the edge portions of the first and the second openings 11*d* and 11*e*, respectively.

FIGS. 20 through 24 show various examples of a configuration of a side surface of the projection 11*g*.

Figure 20:
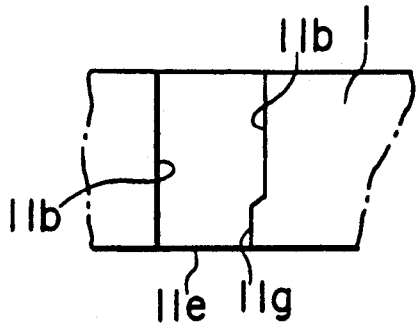
FIGS. 20–24 show various examples of a configuration of a projection formed in the cable guide block according to this invention.

In the cable guide block 1 illustrated in FIG. 20, the projection 11*g* has a side surface which is slanted by about 45° with respect to the wall surface 11*b*.

Figure 21:
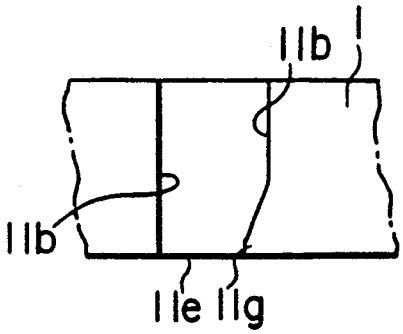

In the cable guide block 1 illustrated in FIG. 21, the projection 11*g* has a side surface which is gradually slanted with respect to the wall surface 11*b*.

Figure 22:
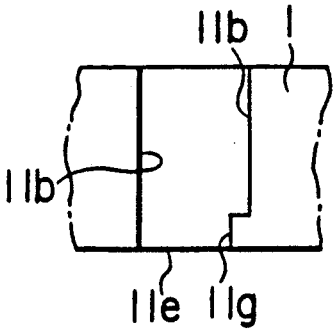

In the cable guide block 1 illustrated in FIG. 22, the projection 11*g* has a side surface which is perpendicular to the wall surface 11*b*.

Figure 23:
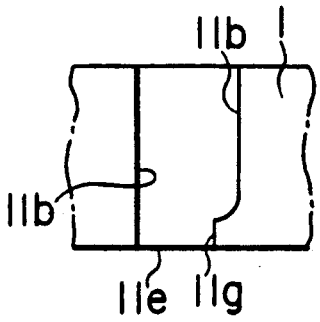

In the cable guide block 1 illustrated in FIG. 23, the projection 11*g* has a side surface curved to form a concave shape.

Figure 24:
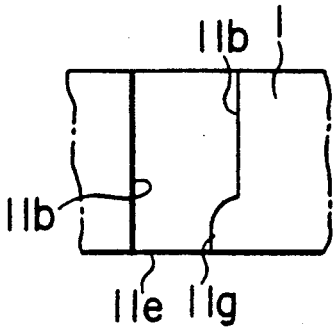

In the cable guide block 1 illustrated in FIG. 24, the projection 11*g* has a side surface curved to form a convex shape.

In the illustrated examples, the projection 11*g* is formed on the wall surface 11*b* in the vicinity of the edge portion of the second opening 11*e*. It is noted here that these configurations are also applicable to the projection 11*g* formed in the vicinity of the edge portion of the first opening 11*d*.

Figure 5:
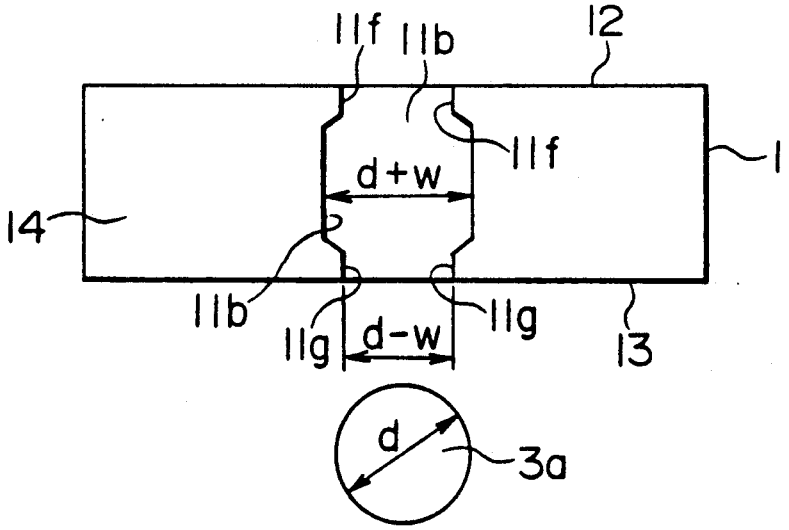
FIG. 5 is a view for describing a width of a groove in the press contact operation by the use of the cable guide block according to the first embodiment of this invention.
Figure 25:
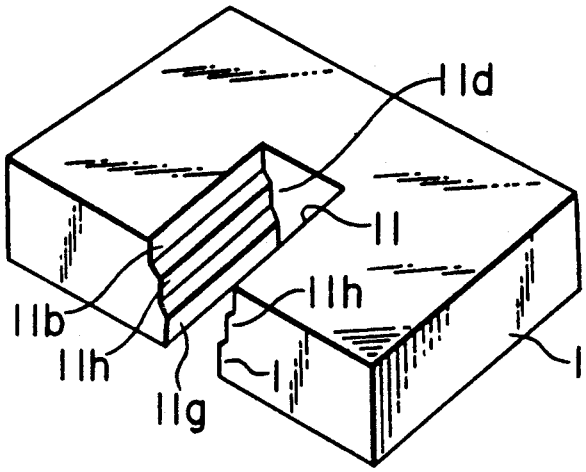
FIG. 25 is a perspective view illustrating a cable guide block according a still further embodiment of this invention.

In the cable guide block 1 illustrated in FIG. 25, the projection 11*g* is provided with at least one step portion 11*h* on its side surface. Accordingly, a distance between the projections 11*g* is gradually reduced from the diameter d of the cable 3. In the cable guide block 1, a distance $(d+w)$ between the pair of the wall surfaces 11*b* is slightly larger than the diameter d of the cable 3, as illustrated in FIG. 5. A distance $(d-(w-\alpha))$ between the step portions 11*h* at the upper portions of the projections 11*g* is smaller than the diameter d of the cable 3. Herein, $\alpha$ represents a height of the step portion 11*h*. Accordingly, in this embodiment also, when the cable pusher 2 is moved downwards, the sheath of the cable 3 is elastically deformed by the step portions 11*h* to pass therethrough. Furthermore, the sheath of the cable 3 is further elastically deformed by the projections 11*g* to pass therethrough and is brought into press contact with the cable connection portion 6*b* of the connector 6. In this connection, the end portion 3*a* of the cable 3 is forced to be kept straight along an axial direction when pushed out from the guide groove 11.

In the above-mentioned embodiments, description is directed to the connector 5 having the cable connection portion 6*a* which is brought into press contact with the cable 3. It is noted here that the above-described cable guide block 1 is also applicable to the connector 5 having a cable connection portion 6*a* which is press-bonded to the end portion 3*a* of the cable 3.

According to the above-described cable guide block 1 for use in the cable connection processing apparatus, the wall surfaces 11*b* are provided with the projections 11*f* and 11*g*. Accordingly, it is possible to accurately guide the end portion 3*a* of the cable 3 in the guide groove 11 to place the end portion 3*a* in a proper position. As a result, it is possible to improve efficiency and reliability of connection processing between the end portion 3*a* of the cable 3 and the cable connection portion 6*a* of the connector 6.

What is claimed is:

1. A cable guide block which has a guide groove for receiving an end portion of a cable and which is for use in a cable connection processing apparatus for carrying out a cable connection operation by moving a cable pusher with respect to said guide groove, said movement being in a direction perpendicular to a cable receiving direction in order to press the end portion of said cable onto a cable connection portion of a contact disposed below said guide groove, said cable guide block comprising;

a first surface facing said cable pusher for pushing the end portion of said cable onto said cable connection portion;

a second surface opposite to said first surface;

a third surface perpendicular to said first and said second surface; and said guide groove being formed in said third surface to extend along said cable receiving direction, said guide groove extending from said first surface to said second surface;

said guide groove comprising;

a cable inserting opening formed in said third surface for receiving the end portion of said cable;

a pair of wall surfaces for guiding the end portion of said cable, said pair of wall surfaces being spaced at a distance which is greater than a diameter of said cable;

a bottom surface for receiving the end face of said cable;

a first opening formed in said first surface for receiving said cable pusher;

a second opening formed in said second surface for permitting the end portion of said cable to be pushed out therethrough;

at least one projection formed on at least one of said wall surfaces so that the distance between said wall surface is less than the diameter of said cable, said portion of said cable being forced past the position where said projection is in an electrically deformed condition.

2. A cable guide block for use in a cable connection processing apparatus as claimed in claim 1, characterized in that said projection is formed in the vicinity of an edge portion of said first opening.

3. A cable guide block for use in a cable connection processing apparatus as claimed in claim 1, characterized in that said projection is formed in the vicinity of an edge portion of said second opening.

4. A cable guide block for use in a cable connection processing apparatus as claimed in claim 1, characterized in that said projection is formed on each of said wall surfaces in the vicinity of an edge portion of said first opening.

5. A cable guide block for use in a cable connection processing apparatus as claimed in claim 1, characterized in that said projection is formed on each of said wall surfaces in the vicinity of an edge portion of said second opening.

6. A cable guide block for use in a cable connection processing apparatus as claimed in claim 1, characterized in that said projections are formed on each of said wall surfaces in the vicinity of edge portions of said first and said second openings.

7. A cable guide block for use in a cable connection processing apparatus as claimed in claim 1, characterized in that said projection is formed into a rib shape.

8. A cable guide block for use in a cable connection processing apparatus as claimed in claim 1, characterized in that said projection has a side surface perpendicular to said wall surface.

9. A cable guide block for use in a cable connection processing apparatus as claimed in claim 1, characterized in that said projection has a side surface slanted against said wall surface.

10. A cable guide block for use in a cable connection processing apparatus as claimed in claim 1, characterized in that said projection has a side surface curved into a concave shape.

11. A cable guide block for use in a cable connection processing apparatus as claimed in claim 1, characterized in that said projection has a side surface curved into a convex shape.

12. A cable guide block for use in a cable connection processing apparatus as claimed in claim 1, characterized in that said projection has a side surface provided with at least one step portion.

13. A cable guide block for use in a cable connection processing apparatus as claimed in claim 12, characterized in that the distance between said wall surfaces is partially made smaller than the diameter of said cable by presence of said step portion and is further made smaller by presence of said projection.

* * * * *